US007509981B2

(12) United States Patent
Froment et al.

(10) Patent No.: US 7,509,981 B2
(45) Date of Patent: Mar. 31, 2009

(54) HEALD FRAME AND WEAVING MACHINE EQUIPPED WITH SAME

(75) Inventors: Jean-Paul Froment, Dousssard (FR); Patrick Iltis, Saint Jorioz (FR)

(73) Assignee: Staubli Faverges, Faverges (FR)

( * ) Notice: Subject to any disclaimer, the term of this patent is extended or adjusted under 35 U.S.C. 154(b) by 0 days.

(21) Appl. No.: 10/564,824

(22) PCT Filed: Jul. 19, 2004

(86) PCT No.: PCT/FR2004/001910

§ 371 (c)(1),
(2), (4) Date: Jan. 18, 2006

(87) PCT Pub. No.: WO2005/007952

PCT Pub. Date: Jan. 27, 2005

(65) Prior Publication Data

US 2006/0162802 A1 Jul. 27, 2006

(30) Foreign Application Priority Data

Jul. 18, 2003 (FR) ..... 03 08819

(51) Int. Cl.
*D03C 13/00* (2006.01)
*D03C 9/06* (2006.01)
*D03C 9/02* (2006.01)

(52) U.S. Cl. ..... 139/93; 139/89; 139/91; 139/92

(58) Field of Classification Search ..... 139/91, 139/92, 93, 89
See application file for complete search history.

(56) References Cited

U.S. PATENT DOCUMENTS

| | | | | |
|---|---|---|---|---|
| 3,071,164 | A | 1/1963 | Nussbaum | |
| 3,895,655 | A * | 7/1975 | Sujdak et al. | 139/92 |
| 4,106,529 | A | 8/1978 | Kaufmann | |
| 4,106,530 | A * | 8/1978 | Kaufmann | 139/92 |
| 5,232,025 | A | 8/1993 | Gysin et al. | |
| 6,009,918 | A * | 1/2000 | Beyaert | 139/92 |
| 6,230,756 | B1 * | 5/2001 | Baumann et al. | 139/93 |
| 6,789,580 | B1 * | 9/2004 | Cardoen et al. | 139/92 |
| 6,883,554 | B2 * | 4/2005 | Baumann et al. | 139/93 |
| 6,981,527 | B2 * | 1/2006 | Froment | 139/93 |
| 6,994,122 | B2 * | 2/2006 | Cardoen et al. | 139/91 |

(Continued)

FOREIGN PATENT DOCUMENTS

DE 918 020 9/1954

(Continued)

*Primary Examiner*—Bobby H Muromoto, Jr.
(74) *Attorney, Agent, or Firm*—Dowell & Dowell, P.C.

(57) ABSTRACT

The invention concerns a frame comprising two posts (4, 4') and two cross-members (6, 6'), a catching member (8, 8') adapted to receive one corresponding end of at least one heald (10), and damping means (12, 12') against which at least one end of the heald is urged to be pressed. At least when the frame is stationary, the heald being substantially rectilinear, when one first end of the or each heald (10) is pressed, either on a first catching member (8) at the traction zone ($S_1$) thereof, or on a first damping means (12) at the compression zone ($C_1$) thereof, the other end of the or each heald (10) is pressed, either on other damping means (12') at the compression zone ($C'_1$) thereof, or on another catching member (8') at the traction zone ($S'_1$) thereof.

16 Claims, 2 Drawing Sheets

U.S. PATENT DOCUMENTS

| | | | | |
|---|---|---|---|---|
| 7,036,532 | B2 * | 5/2006 | Bauder et al. | 139/52 |
| 7,147,010 | B2 * | 12/2006 | Froment et al. | 139/91 |
| 7,185,679 | B2 * | 3/2007 | Schwemmlein et al. | 139/93 |
| 7,204,274 | B2 * | 4/2007 | Mettler | 139/93 |
| 2003/0150506 | A1 * | 8/2003 | Baumann et al. | 139/93 |
| 2005/0022893 | A1 | 2/2005 | Cardoen et al. | |

FOREIGN PATENT DOCUMENTS

| | | |
|---|---|---|
| EP | 0457210 | 11/1991 |
| WO | WO 97 26396 | 7/1997 |
| WO | WO 01/48284 | 7/2001 |

* cited by examiner

HEALD FRAME AND WEAVING MACHINE EQUIPPED WITH SAME

BACKGROUND OF THE INVENTION

1. Field of the Invention

The present invention relates to a heald frame, and to a weaving machine equipped with at least one such frame.

2. Brief Description of the Related Art

It is known to equip a weaving machine with heald frames which are to be driven in a vertically oscillating movement by means of an appropriate device, such as a heald loom or a dobby.

Such a heald frame first of all comprises a body which is formed by the reversible assembly of two posts and two cross-members. During operation, the posts are substantially vertical, while the cross-members are substantially horizontal. Each cross-member also supports a catching member, also called a bar, which permits the fixing of a corresponding end of the healds of the weaving machine.

The invention relates more particularly to such a heald frame which is provided with damping means interposed between the cross-members and the healds in the region of at least one end thereof. In this manner, during oscillation of the frame, some of the direct contact between the catching member and the healds is suppressed, which reduces the vibrations caused by the healds' rebounding on the bars and, consequently, the overall wear to which those various mechanical elements are subjected, while increasing the service life.

Heald frames are known which are provided with damping means against which a first end of the heald comes to bear before the opposite end of the heald comes into contact with the corresponding catching member.

This known solution has a disadvantage, however, in that it induces substantial bending of the cross-member supporting the damping means. The cross-member is therefore subjected to considerable vibrations, so that it is weakened.

SUMMARY OF THE INVENTION

In the light of the above, the invention proposes to remedy that disadvantage of the prior art.

To that end, the invention relates to a heald frame for a weaving machine. The frame includes two posts and two cross-members and a damping member, each cross-member being provided with a catching member suitable for receiving a corresponding end of at least one heald of the frame. The damping means which are mounted to at least one corresponding catching member or cross-member and against which at least one end of the heald engages when the frame is in a stationary state and the heald is in a rectilinear configuration, such that when a compression zone of a first end of the at least one heald is engaging the damping member, a traction zone at the other end of the at least one heald substantially engages an adjacent catching member.

The invention relates also to a weaving machine equipped with at least one heald frame as defined above.

BRIEF DESCRIPTION OF THE DRAWINGS

The invention will be better understood, and other advantages will become more clearly apparent, in the light of the description which will be given hereinbelow of a weaving machine and of two heald frames in accordance with the principle of the invention, which are given solely by way of non-limiting examples and with reference to the accompanying drawings, in which.

DESCRIPTION OF THE PREFERRED EMBODIMENT

Figure 1:
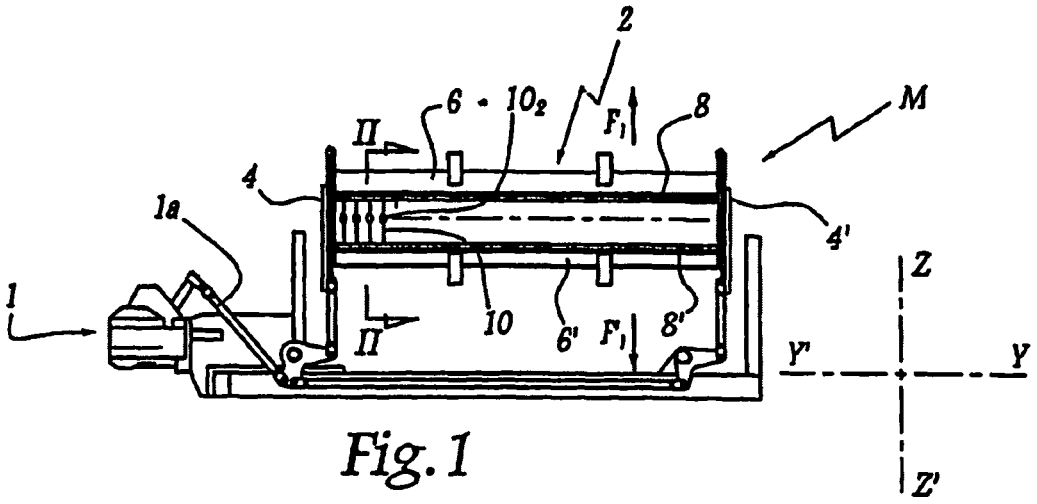
FIG. 1 is a skeleton view, in diagrammatic form, of a weaving machine according to the invention.

In FIG. 1, a dobby 1 of a type known per se is intended to move a heald frame 2 belonging to a weaving machine M, according to a vertically oscillating movement indicated by the arrows $F_1$ and $F'_1$. To that end, a driving arm 1*a* of the dobby is coupled to each heald frame 2 by means of rods and oscillating levers. The machine M comprises a plurality of frames, generally from six to twenty-four, only one of which is shown in FIG. 1 for the sake of clarity.

Each frame 2 comprises a body which is formed by the assembly of two posts 4, 4' and two cross-members 6, 6'. The posts 4, 4' extend generally in a direction parallel to the direction of vertical oscillation Z-Z' of the frames, namely vertically during operation. In addition, the cross-members 6, 6' extend in a direction Y-Y' perpendicular to the above-mentioned direction Z-Z', namely horizontally during operation.

Each upper and lower cross-member 6 and 6', respectively, is equipped, in known manner, with a corresponding catching member or bar 8, 8'. The bars 8 and 8', which will be described in greater detail hereinbelow, permit the fixing of the upper and lower ends, respectively, of various healds 10 belonging to the frame 2 of the weaving machine M.

Figure 2:
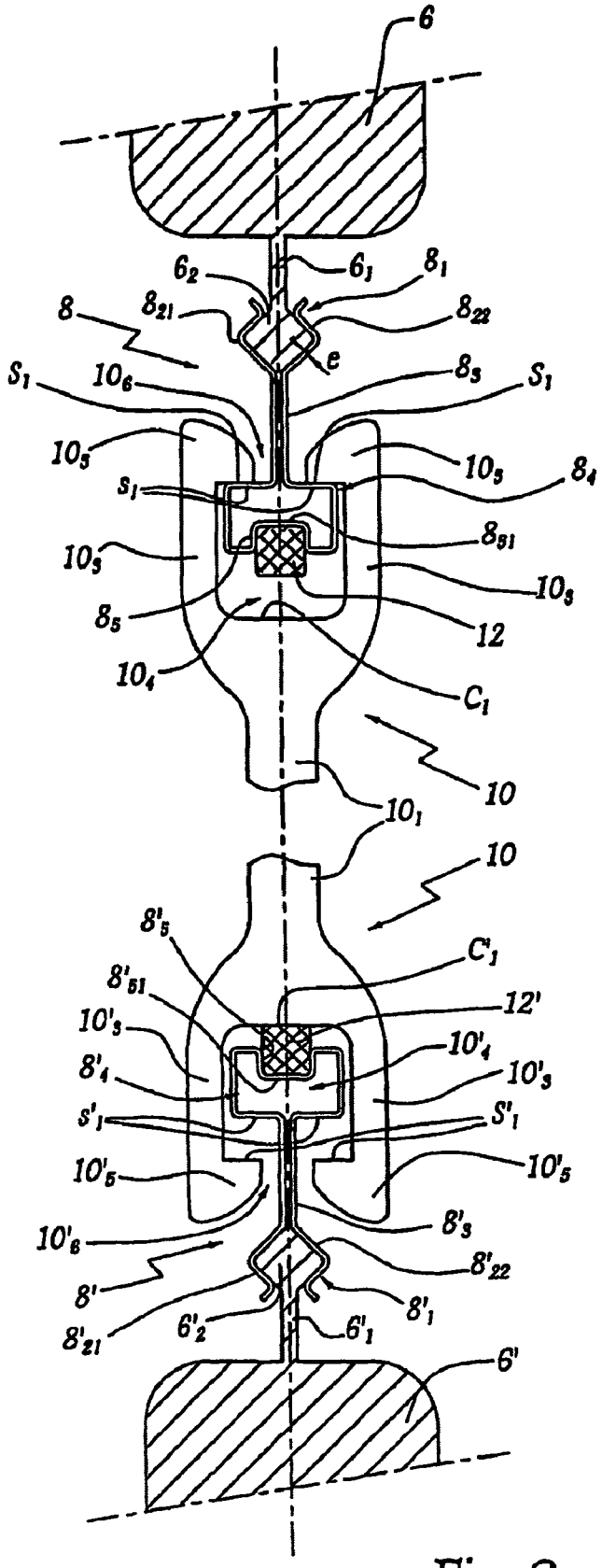
FIG. 2 is a view in transverse section, according to line II-II in FIG. 1, showing part of a heald frame belonging to the weaving machine of FIG. 1, in particular with regard to the mutual fixing of a cross-member, a catching member and a heald belonging to the frame.

FIG. 2 shows the fixing of the upper end of a heald 10 to the upper cross-member 6 by means of the bar 8. It is to be noted that the fixing of the lower end of the heald 10 to the cross-member 6' is carried out in an analogous manner by means of the bar 8'. With this in mind, the mechanical elements of the lower cross-member 6', of the lower bar 8' and of the lower end of the heald 10, which are analogous to those of the upper cross-member 6, the upper bar 8 and the upper end of the heald 10, respectively, bear the same numerals with the associated reference "prime".

The structure of the upper cross-member 6, which is conventional, will not be described in greater detail in the following. The bottom face of the cross-member 6, facing the heald 10, is prolonged by a rib $\mathbf{6}_1$ extending over the whole of the major dimension of the cross-member.

The rib $\mathbf{6}_1$ is prolonged by a lug $\mathbf{6}_2$ which, in transverse section, is substantially lozenge-shaped.

The catching bar 8 is formed by a thin metal sheet which has been folded back on itself, the thickness e of which is, for example, around 0.7 mm. It comprises first of all a region $\mathbf{8}_1$ permitting the fixing of the bar 8 to the cross-member 6 by cooperative shaping thereof.

More precisely, the fixing region is formed by two limbs $\mathbf{8}_{21}$ and $\mathbf{8}_{22}$ which are generally L-shaped and the angles of which are disposed facing one another in such a manner as to cover the above-mentioned lug $\mathbf{6}_2$. It is also to be noted that the limbs $\mathbf{8}_{21}$, $\mathbf{8}_{22}$ constitute the free ends of the folded metal sheet forming the catching bar 8. The existence of the lug $\mathbf{6}_2$, associated with the limbs $\mathbf{8}_{21}$ and $\mathbf{8}_{22}$, accordingly imparts a removable nature to the fixing of the bar 8 to the cross-member 6.

The two limbs $8_{21}$ and $8_{22}$ come together, facing the cross-member 6, in an intermediate region $8_3$ of reduced transverse cross-section. Finally, the region $8_3$ is prolonged by a region $8_4$ which is intended to catch the heald 10, which will be described in greater detail in the following.

The heald 10 comprises, in conventional manner, a filiform element $10_1$ provided with an eyelet $10_2$, shown in FIG. 1, for the passage of a warp thread (not shown). At each end of the heald, the filiform element $10_1$ is prolonged by two principal limbs $10_3$ which define a receiver $10_4$ for receiving the bar 8. The mouth of the receiver is bordered by two teeth $10_5$ of the heald, which teeth extend towards one another to form a neck $10_6$ of restricted transverse dimensions.

Returning to the catching region $8_4$, that region has an approximately rectangular transverse cross-section, the dimensions of which are slightly greater than those of the intermediate region $8_3$. In its lower portion remote from the cross-member 6, the catching region $8_4$ forms a U-shaped reentrant portion $8_5$, the core $8_{51}$ of which is turned towards the cross-member 6.

The reentrant portion serves to hold a damping element 12 of a type known per se, which is a flexible element made, for example, of a polymeric material, an elastomeric material or the like. Such a damping element, which extends over substantially the whole of the major dimension of the cross-member 6, is held by clamping and/or adhesive bonding in the U-shaped internal volume of the reentrant portion $8_5$. It will be noted that the damping element 12 is received in the receiver $10_4$ for receiving the bar 8.

When the weaving machine M is in its use configuration, the intermediate region $8_3$ is received in the neck $10_6$, while the catching region $8_4$ is received in the receiver $10_4$. The same is true of the lower end of the cross-member, the various mechanical elements being disposed symmetrically relative to the median horizontal axis of the frame 2.

More precisely, $s_1$ denotes the surfaces of the upper catching bar 8 which are capable of coming to bear directly on the facing surfaces $S_1$ of the heald, belonging to the two teeth $10_5$. The direct bearing surfaces $s_1$ and $S_1$ form a traction zone of the heald, opposite the compression zone, corresponding to the free surfaces of the damping element 12 and those $C_1$ facing the heald 10.

FIG. 2 shows the heald in a stationary state in which it is substantially rectilinear. When the upper end of the heald is bearing directly, by way of its surfaces $S_1$, against the facing upper surfaces $s_1$ of the bar 8, the lower end of the heald bears substantially against the lower damping element 12', in the region of its lower compression surfaces $C'_1$. Of course, in a manner not shown in FIG. 2, when the lower end of the heald is bearing directly, by way of its traction surfaces $S'_1$, on the surfaces $s'_1$ of the lower bar 8', the upper portion of the heald bears substantially, by way of its upper compression surfaces $C_1$, against the upper damping element 12.

It should be noted that this arrangement is aimed at nominal manufacturing dimensions, it being understood that the manufacturing tolerances, in particular those relating to the straightness of the cross-members, enable these nominal dimensions to be achieved only approximately, in practice with greater or lesser deviations associated with these geometrical deviations. However, it is the average, or nominal, values which will obey the principle of the substantially simultaneous double contact, as mentioned above.

Such a measure is advantageous. The upper and lower cross-members 6 and 6', respectively, are subjected to vibrations during operation, which imparts a variable nature to their spacing. The healds come into contact with the bar and with the damping element, respectively, sometimes by way of their traction surfaces and sometimes by way of their compression surfaces, the impacts on the compression surfaces contributing to damping the vibrations.

The fact that substantially simultaneous bearing is provided on the lower or upper traction surfaces and on the upper or lower compression surfaces allows the cross-members 6 and 6' to be operated in a configuration in which the healds are substantially rectilinear. This is favourable to the transmission of a maximum compression force. One of the two cross-members, which acts as a damper, therefore absorbs a considerable force and allows the bending of the other cross-member to be reduced, then providing a traction force. In other words, the heald control force is transmitted by the two cross-members at the same time, which reduces the bending of the cross-members substantially by half.

Moreover, during oscillation of the frame 2, the presence of the upper and lower damping elements 12 and 12', respectively, enables the axial oscillation vibrations of the healds and their impacts on the bars to be reduced. This therefore brings about a reduction in the overall wear to which the healds and the bars are subjected and, consequently, an increase in their service life.

In FIG. 2, the upper and lower bars 8 and 8' are equipped with damping means 12 and 12', respectively. It is possible, however, to provide only one of the bars 8 or 8' with such damping means, while the other bar 8' or 8 is devoid of such means. In that case, when the only damping means 12 or 12', which are integral with the bar 8 or 8', are in contact with the compression surfaces of the facing end of the heald, the other end thereof is advantageously in contact, by way of its traction surfaces $S'_1$ or $S_1$, with the other facing catching bar 8' or 8.

Figure 3:
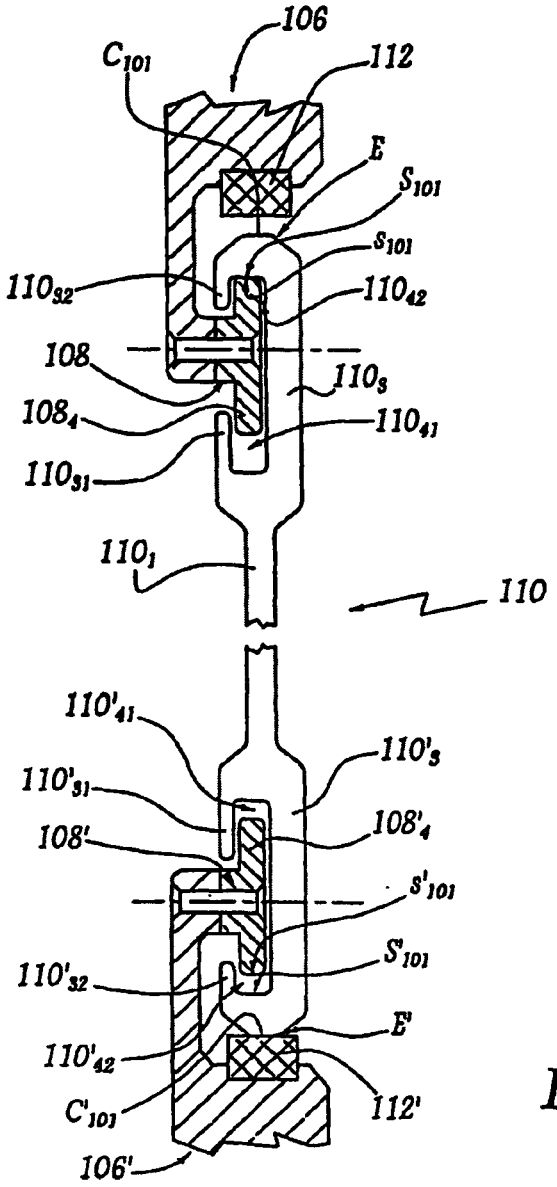
FIG. 3 is a view in transverse section, analogous to that of FIG. 2, showing a variant of the invention.

FIG. 3 shows a first alternative embodiment of the invention. In that Figure, mechanical elements analogous to those of FIG. 2 have been assigned the same reference numerals, increased by 100. As in the first embodiment, the mechanical elements of the lower cross-member 106', of the bar 108' and of the lower end of the heald 110 are analogous to those of the upper cross-member 106, the upper bar 108 and the upper end of the heald, respectively.

The heald 110 in this embodiment differs from the preceding example in that it is asymmetrical. Each of its ends is generally C-shaped, the filiform element $110_1$ being prolonged by a single limb $110_3$ from which there extend an intermediate tooth $110_{31}$ and a return portion $110_{32}$. The tooth and the return portion, which are directed towards one another, define with the limb $110_3$ two channels $110_{41}$, $110_{42}$.

In contrast to the preceding example, the catching bar 108 is fixed to the cross-member 106 by adhesive-bonding or riveting means (not shown) or alternatively by other equivalent means. The catching bar 108 comprises a catching region $108_4$, the ends of which penetrate into the channels $110_{41}$, $110_{42}$.

The cross-member 106 is further provided with a damping element 112 which is fixed, for example, by adhesive bonding. In contrast to the first embodiment, the damping element 112 is situated opposite the free end E of the heald, relative to the filiform body $110_1$ thereof.

Analogously to the first embodiment, FIG. 3 shows the heald 110 in the stationary state in which the heald is substantially rectilinear. When the upper end of the heald is bearing directly, by way of its surfaces $S_{101}$, against the facing upper surfaces $s_{101}$ of the bar 108, the lower end of the heald bears substantially against the lower damping element 112', in the region of its lower compression surfaces $C'_{101}$. Moreover, in a manner not shown in FIG. 3, when the lower end of the heald is bearing directly by way of its traction surfaces $S'_{101}$ on the surfaces $s'_{101}$ of the lower bar 108', the upper portion of the heald bears substantially, by way of its upper compression surfaces $C_{101}$, against the upper damping element 112.

The invention is not limited to the examples that have been described and shown.

For example, the heald may have a different form from that shown in FIGS. 2 and 3. For example, the heald may have a generally J-shaped cross-section, in a manner known per se. In that case, the heald is equipped with a principal limb, while it is provided with only an upper return portion and does not have a lower tooth. The heald may also have an O-shaped cross-section, in a manner known per se, for frames equipped with sliders, likewise of the conventional type.

Moreover, the heald may have a generally C-, J- or O-shaped cross-section, while the damping means are received in the internal volume of the C, J or O, in contrast to the embodiment of FIG. 3 and similarly to the embodiment of FIG. 2. Moreover, the heald may be U-shaped, while the damping means are situated opposite the free end of the heald, relative to its filiform element, in contrast to the embodiment of FIG. 2 and similarly to FIG. 3.

The invention claimed is:

1. A heald frame for a weaving machine, the frame comprising two posts, two cross-members and at least one damping means, each cross-member being provided with a catching member for engaging an adjacent end of at least one heald of the frame, the at least one damping means being mounted to at least one of the cross members or at least one of the catching members, said at least one heald having first and second ends, each of said first and second ends having a compression zone and a traction zone that are in a spaced relationship relative to one another, such that when said frame is in a stationary state and when the at least one heald is substantially rectilinear, the compression zone of the first end of the at least one heald bears against an opposing area of contact of the at least one damping means and the traction zone of the second end of the at least one heald bears against an opposing area of contact of a first adjacent catching member such that the compression zone of the first end and traction zone of the second end simultaneously bear against an opposing area of contact of the at least one damping means and an opposing area of contact of the first adjacent catching member, respectively.

2. The heald frame as claimed in claim 1, wherein the at least one damping means is received in a receiver of the first end of the at least one heald, and the receiver is adapted to receive an end portion of a second adjacent catching member.

3. The heald frame as claimed in claim 1, wherein the at least one damping means is positioned opposite the first end of the at least one heald relative to a filiform body of the at least one heald.

4. The heald frame as claimed in claim 1, wherein at least the first end of the at least one heald has two principal limbs defining a receiver which opens in a direction towards a corresponding cross-member by way of a neck, while the second adjacent catching member includes a catching region which extends into the receiver, as well as an intermediate region that is received in the neck.

5. The heald frame as claimed in claim 1, wherein at least the first end of the at least one heald includes a principal limb defining, with a tooth and a return portion of the at least one heald, at least one receiving channel, while the second adjacent catching member has a catching region extending at least partially into the at least one receiving channel.

6. The heald frame as claimed in claim 1, wherein at least one of the first and second adjacent catching members is removably fixed to a corresponding cross-member by cooperative shaping of two limbs of the at least one of the first and second adjacent catching members and facing walls of an adjacent cross-member.

7. The heald frame as claimed in claim 1, wherein at least one of the first and second catching members is permanently fixed to an adjacent cross-member.

8. The heald frame as claimed in claim 1, wherein at least one of the first and second catching member is formed of at least one folded metal sheet.

9. The heald frame as claimed in claim 1, wherein the at least one damping means includes a damping member the profile of which is constant along the second catching member or the cross-member adjacent the second catching member.

10. The heald frame as claimed in claim 1, including first and second damping means which are spaced relative to one another such that when the compression zone of the second end of the at least one heald bears against an opposing area of contact of the second damping means, the traction zone of the first end of the at least one heald simultaneously bears against an opposing area of contact of the traction zone of a second adjacent catching member.

11. The heald frame as claimed in claim 10, wherein the first and second damping means are mounted to separate ones of the first and second catching members.

12. The heald frame as claimed in claim 10 wherein the first and second damping means are mounted to the cross-members so as to be opposing the first and second ends of the at least one heald.

13. A weaving machine, the weaving machine comprising at least one heald frame, the heald frame comprising two posts, two cross-members and at least one damping means, each cross-member being provided with a catching member for engaging an adjacent end of at least one heald of the frame, said at least one heald having first and second ends, each of said first and second ends having a compression zone and a traction zone that are spaced relative to one another, such that when said frame is in a stationary state and when the at least one heald is substantially rectilinear, the compression zone of the first end of the at least one heald bears against an opposing area of contact of the at least one damping means and the traction zone of the second end of the at least one heald bears against an opposing area of contact of a first adjacent catching member such that the compression zone of the first end and traction zone of the second end simultaneously bear against an opposing area of contact of the at least one damping means and an opposing area of contact of the first adjacent catching member, respectively.

14. The weaving machine of claim 13 including first and second damping means which are spaced relative to one another such that when the compression zone of the second end of the at least one heald bears against an opposing area of contact of the second damping means, the traction zone of the first end of the at least one heald simultaneously bears against an opposing area of contact of the traction zone of a second adjacent catching member.

15. The weaving machine of claim 14 wherein the first and second damping means are mounted to separate ones of the first and second catching members.

16. The weaving machine of claim 14 wherein the first and second damping means are mounted to the cross-members so as to be opposing the first and second ends of the at least one heald.

* * * * *